US011438982B2

(12) United States Patent
Song

(10) Patent No.: US 11,438,982 B2
(45) Date of Patent: Sep. 6, 2022

(54) LED PULSE WIDTH MODULATION WITH ACTIVE TURN-OFF

(71) Applicant: Lumileds LLC, San Jose, CA (US)

(72) Inventor: Zhi Hua Song, Palo Alto, CA (US)

(73) Assignee: Lumileds LLC, San Jose, CA (US)

( * ) Notice: Subject to any disclaimer, the term of this patent is extended or adjusted under 35 U.S.C. 154(b) by 13 days.

(21) Appl. No.: 16/991,489

(22) Filed: Aug. 12, 2020

(65) Prior Publication Data

US 2021/0051781 A1 Feb. 18, 2021

Related U.S. Application Data

(60) Provisional application No. 62/888,246, filed on Aug. 16, 2019.

(51) Int. Cl.
*H05B 45/325* (2020.01)
*H05B 45/44* (2020.01)
*G09G 3/32* (2016.01)

(52) U.S. Cl.
CPC ..... *H05B 45/325* (2020.01); *H05B 45/44* (2020.01)

(58) Field of Classification Search
CPC ..... H05B 45/10; H05B 45/30; H05B 45/31; H05B 45/325; H05B 45/44; H05B 45/46; H05B 45/52; G09G 3/3225; G09G 3/3233; G09G 3/34; G09G 3/3406; G09G 3/32
See application file for complete search history.

(56) References Cited

U.S. PATENT DOCUMENTS

2010/0285472 A1* 11/2010 Choi ..... C12Q 1/708 435/5
2012/0274877 A1* 11/2012 Sasaki ..... H05B 45/14 349/69
2012/0306388 A1* 12/2012 Jang ..... H02M 3/156 315/186
2014/0042925 A1* 2/2014 Wang ..... H05B 45/48 315/232
2014/0111102 A1* 4/2014 Angelin ..... H05B 45/46 315/186
2014/0211192 A1* 7/2014 Grootjans ..... G01S 17/10 356/5.01
2018/0040276 A1* 2/2018 Cronin ..... G09G 3/3406
2018/0070417 A1* 3/2018 Galvano ..... H05B 45/56
2019/0045595 A1* 2/2019 Johnsen ..... H05B 45/46

FOREIGN PATENT DOCUMENTS

WO WO-2019/108553 A1 6/2019

OTHER PUBLICATIONS

"International Application Serial No. PCT/US2020/046083, International Search Report dated Nov. 11, 2020", 4 pgs.
"International Application Serial No. PCT/US2020/046083, Written Opinion dated Nov. 11, 2020", 7 pgs.

* cited by examiner

*Primary Examiner* — Thai Pham
(74) *Attorney, Agent, or Firm* — Schwegman Lundberg & Woessner, P.A.

(57) ABSTRACT

A control system for an LED array includes a pulse width modulator to supply signals having rising edges and a falling edges to the plurality of LEDs. A plurality of parasitic capacitance discharge circuit elements connected in parallel between the pulse width modulator and the respective LEDs.

14 Claims, 6 Drawing Sheets

LED PULSE WIDTH MODULATION WITH ACTIVE TURN-OFF

CLAIM OF PRIORITY

This application claims the benefit of priority to U.S. Provisional Application Ser. No. 62/888,246, filed on 16 Aug. 2019, and entitled "LED PULSE WIDTH MODULATION WITH ACTIVE TURN-OFF", which is incorporated herein in its entirety by reference.

TECHNICAL FIELD

The present disclosure relates generally to a light emitting diode (LED) pulse width modulation (PWM) circuit and technique that improves control of rising and falling pulse edges. The technique is usable in lighting systems based on large micro-LED pixel arrays.

BACKGROUND

A lighting system with an LED array matrix and a constant input voltage power supply often uses PWM control for dimming and/or color tuning functionality. For example, an array including n LED modules, where n is an integer greater than or equal to one (1), each of which has one or multiple LEDs connected in series and/or parallel, can be driven by a pulse width modulation (PWM) source. Typically, each LED module is driven by a PWM current source that switches on and off at a certain frequency and with a certain ratio of turn-on time to the period, also known as (A.K.A.) duty cycle. The PWM duty cycle and current amplitude of the current sources may be different to achieve individual control of the dimming and/or color each LED module.

However, one issue with PWM driving regards passive turn-off of the LEDs. Compared to active turn-on through the current sources, the turn-off is passive and the LEDs are essentially left floating. At the moment of turn-on, the parasitic capacitance in parallel to LEDs is actively charged by the current sources. At the moment of turn-off, however, the parasitic capacitance can only be discharged by the gradually reduced forward current of the LED. This results in the falling edge of LED current during discharge being slower and taking a longer time than the rising edge during charge. This longer discharge can limit the maximum PWM frequency as well as result in less accurate average current control.

This issue can be of particular importance for large matrix pixel arrays of LEDs that already face power and data management problems. These matrix pixel arrays can manage individual light intensity of thousands of emitting pixels and, for some application, can be controlled at refresh rates of 30-60 Hz, and passive turn-off reduces potential imaging frequency.

SUMMARY

In some embodiments, a control system for an LED array includes a plurality of LEDS and a pulse width modulator to supply signals having rising edges and falling edges to the plurality of LEDs. A plurality of discharge circuit elements are connected in parallel between the pulse width modulator and the respective LEDs.

In some embodiments, the plurality of LEDs comprise a matrix pixel array.

In some embodiments, the rising edges and falling edges have a same or substantially similar slope.

In some embodiments, the plurality of LEDs are either common anode LEDs or common cathode LEDs.

In some embodiments, the discharge circuit elements are a plurality of current sources, which can be configured to operate at 180 degrees phase relationship with respect to the pulse width modulator. Alternatively, the discharge circuit elements can be a plurality of switches. In some embodiments the switches can include three metal oxide semiconductor field effect transistor (MOSFET) switches M1, M2, and M3, with LED discharge occurring through M1. In other embodiments at least one of the plurality of LEDs is controlled by three MOSFET switches M1, M2, and M3, with M1 being a P-channel MOSFET connected in parallel to LED1 and forming a totem pole pair with a N-Channel MOSFET M2, and discharge occurring through M1.

In some embodiments, the control system for an LED array includes a control module providing an image including pulse width modulation (PWM) data. A pulse width modulator generator is connected to the control module to receive PWM data from the control module and to supply PWM signals having a rising edge and a falling edges to a plurality of LEDs. A plurality of discharge circuit elements are connected between the pulse width modulator and the plurality of LEDs to ensure rising edges and a falling edges of the PWN signals have a same slope.

In some embodiments, a circuit for supplying signals having same slope rising edges and a falling edges to the plurality of LEDs includes a plurality of LEDS connected to receive pulse width modulation signals from a pulse width modulator. A plurality of discharge circuit elements are connected between the pulse width modulator and the respective LEDs. In operation, signals having same slope rising edges and a falling edges are supplied to the plurality of LEDs. The LEDS can be a matrix pixel array and the pulse width modulation signals can be derived from an image signal.

DETAILED DESCRIPTION

Figure 1A:
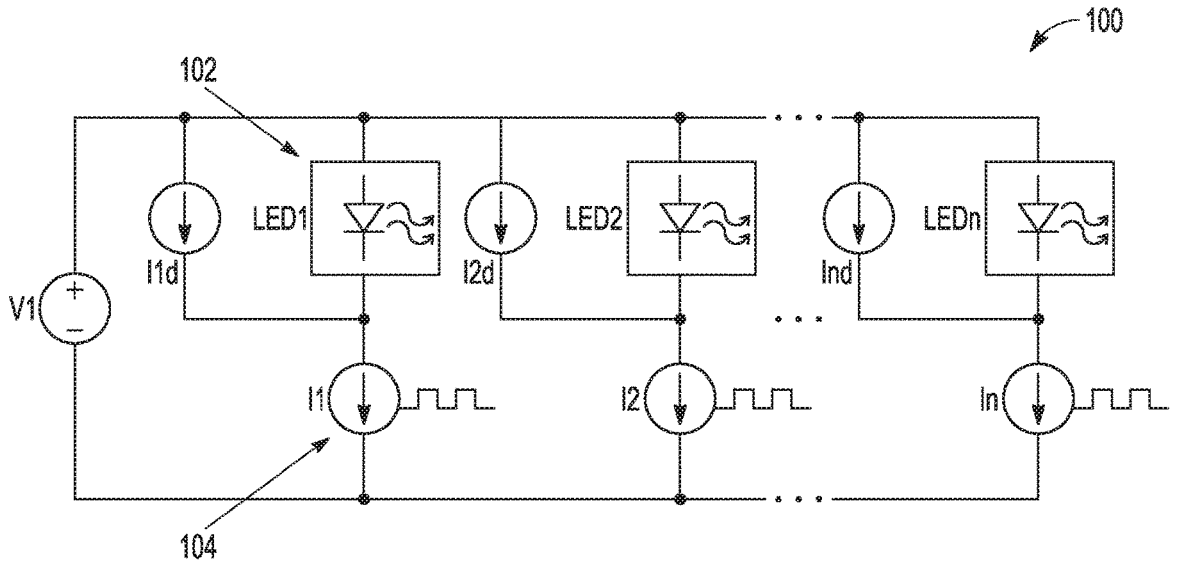
FIG. 1A illustrates a circuit 100 suitable for driving multiple LEDs with pulse width modulated signals.

FIG. 1A illustrates a circuit 100 suitable for driving multiple LEDs with pulse width modulated signals and a scheme for active discharge during LED turn-off. As illustrated, each LED module 102 (LED1, LED2, LEDn) is a common anode LED that has a current source connected in parallel. This is illustrated as current sources 104 I1*d* for LED1, I2*d* for LED2, and Ind for LEDn. The I1*d*, I2*d* and Ind current sources 104 are turned on during their respective pulse width modulation (PWM–I1, I2, In) OFF period to fast discharge the parasitic capacitance, ensuring their phase relation with PWM I1, I2 and In are 180 degrees, respectively. Since current I1*d* through Ind are not ideal current sources and need a minimum voltage to operate, and while the discharge current can be turned on during part of or the whole PWM OFF period, the actual conduction time of the discharge current may be very short and only last till the LED voltage is discharged to zero.

Figure 1B:
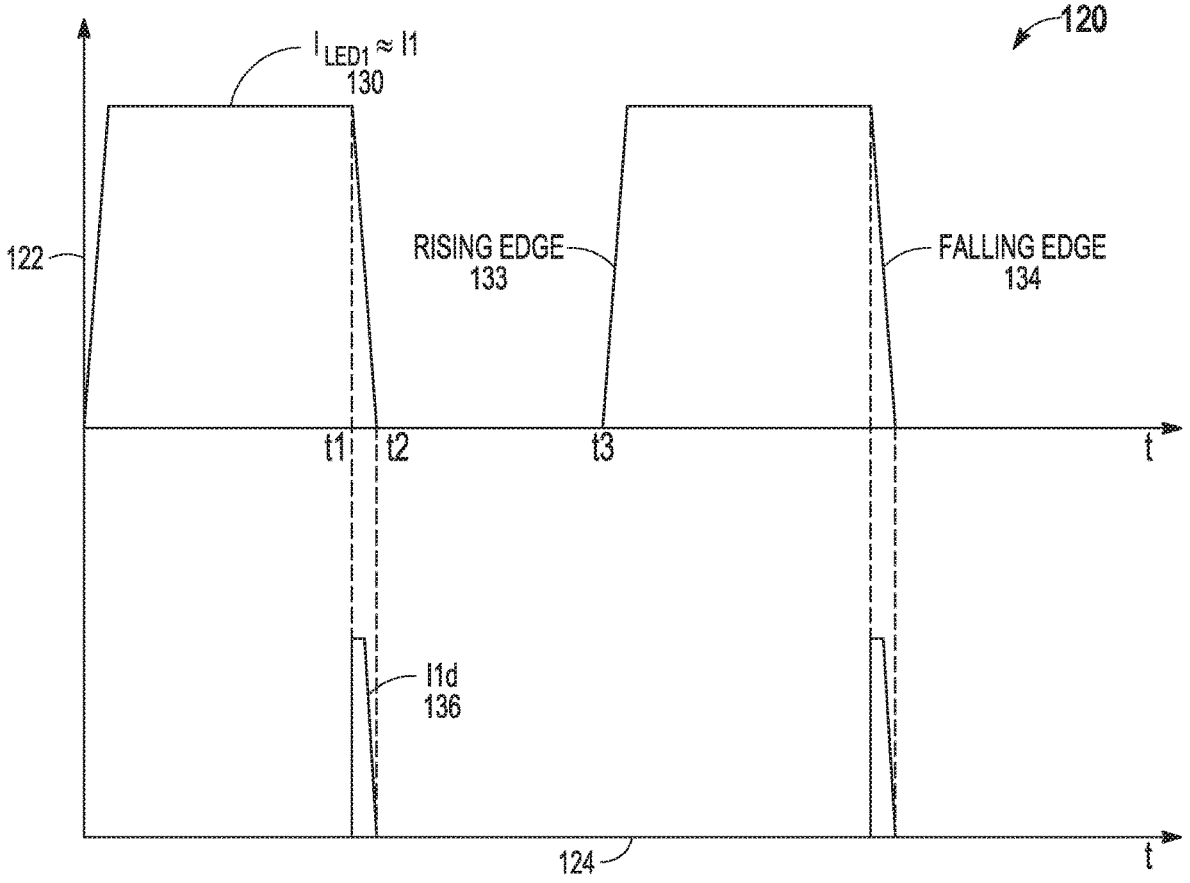
FIG. 1B is a graph illustrating rising and falling edges for a PWM driven LED circuit such as illustrated in FIG. 1A.

This effect is illustrated for LED1 with respect to graph 120 of FIG. 1B having a current amplitude axis 122 and time axis 124. The graph 120 respectively shows a pulse train 130 with repeated rising edge 132 and falling edge 134, and a representative discharge current 136 (I1*d*) which only conducts during the turn-off moment between t1 and t2, though it may be enabled during the whole OFF period between t1 and t3. In addition, it may gradually decrease during the discharge time. Because the conduction time of I1*d* is significantly smaller than that of PWM current I1, the LED current ILED1 approximately equals I1. In some embodiments, by selecting suitable discharge current values with respect to the PWM current source values, it is possible to achieve substantially the same slope for rising and falling edges of the LED current.

Figure 1C:
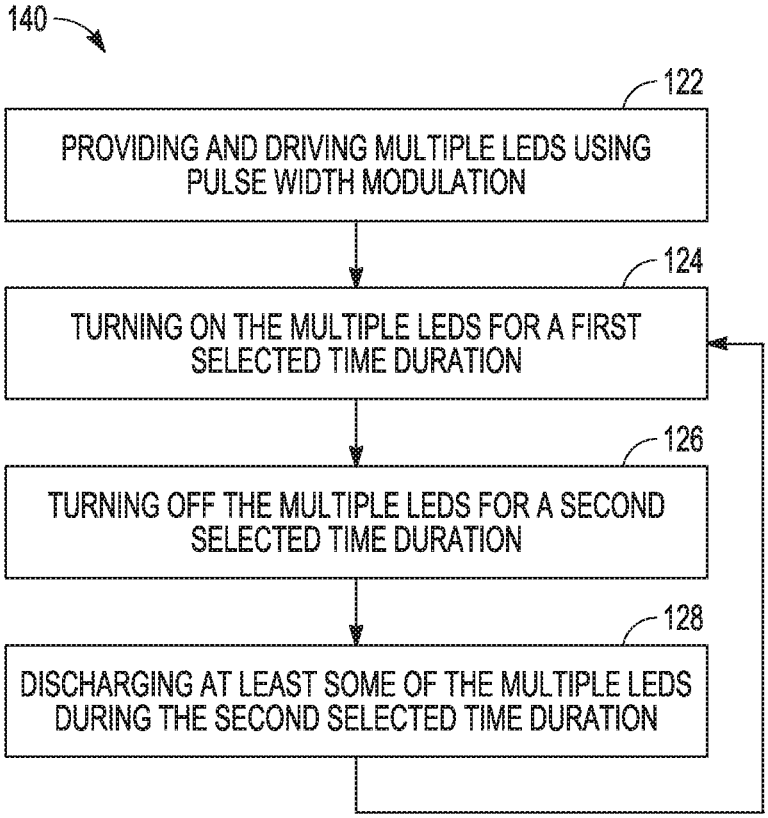
FIG. 1C illustrates an example procedure for active discharge during LED turn-off.

FIG. 1C illustrates an example procedure 140 for active discharge during LED turn-off. In step 122, multiple LEDs are provided and driven using PWM. In step 124, multiple LEDs are turned on with a pulse that operates for a first time duration. Typically, the pulse will have a substantially constant current amplitude, but in some embodiments, may slightly increase or decrease. In step 126 the multiple LEDs are turned off for a second selected duration. In step 128, at least some of the multiple LEDs are discharged during a pulse ramp down. In some embodiments, the multiple LEDs can be connected to a discharge circuit until the multiple LEDs are turned on again. This process can be repeated as necessary.

Figure 2:
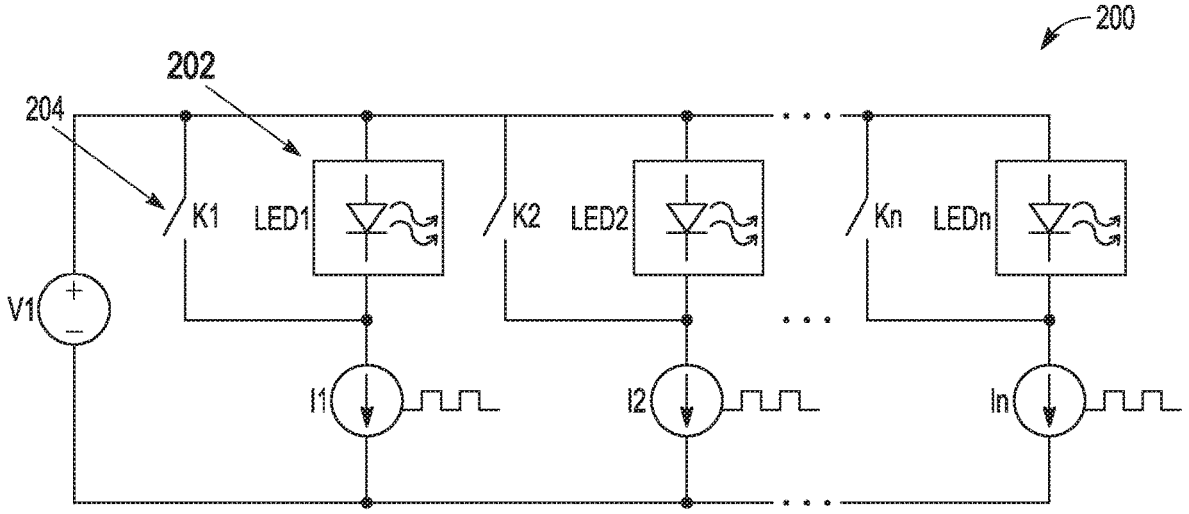
FIG. 2 is alternative circuit suitable for driving multiple LEDs with pulse width modulated signals.

FIG. 2 illustrates an alternative circuit suitable for driving multiple LEDs 202 with PWM signals and a scheme for active discharge during LED turn-off. In this embodiment a discharge current source 204 such as illustrated with respect to FIG. 1 is replaced with a switch system 204. In the illustrated embodiment, the current I1*d* through Ind of FIG. 1 are replaced by switch K1 through Kn, respectively. The switches may be turned on during part of or the whole PWM OFF period, which would essentially short circuit the respective common anode LEDs. While this may result in faster discharge time than charge time, the effect of charge/discharge time asymmetry on the accuracy of average LED current would be very small and substantially the same slope for rising and falling edges of the LED current is achievable. This is at least because the active charge time is already much shorter than the PWM cycle time.

Figure 3:
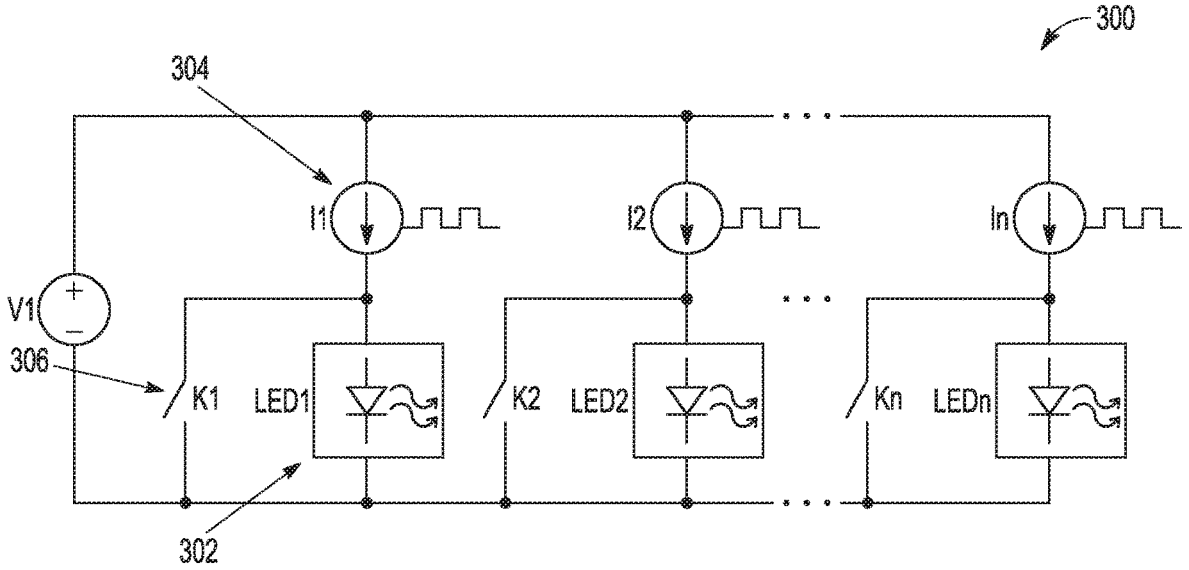
FIG. 3 is an alternative circuit suitable for driving multiple common cathode LEDs with pulse width modulated.

FIG. 3 illustrates an alternative circuit suitable for driving multiple LEDs with PWM signals and scheme for active discharge during LED turn-off. In this embodiment LEDs seen with respect to FIGS. 1A and 2 are replaced with common cathode LEDs 302. Switches 306 (K1 through Kn) are respectively connected between PWM current sources 304 (I1 through 1N) and may be turned on during part of or the whole PWM OFF period to ensure that substantially the same slope for rising and falling edges of the LED current is achievable.

Figure 4:
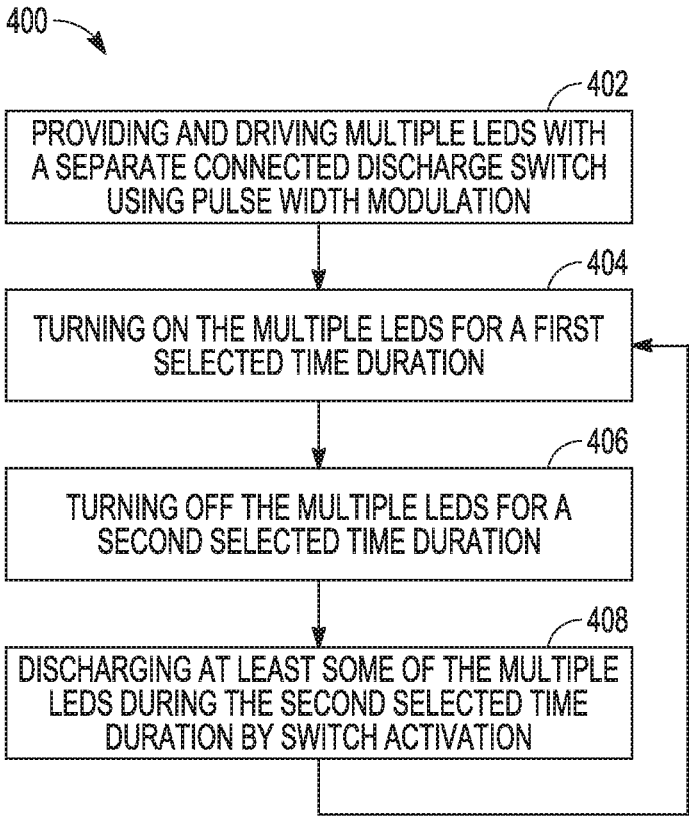
FIG. 4 illustrates an example procedure for active discharge using switches during LED turn-off.

FIG. 4 illustrates an example procedure 400 for switch controlled active discharge during LED turn-off. This procedure can be used, for example, to control circuitry such as discussed with respect to FIGS. 2 and 3. In step 402, multiple LEDs with switch controlled active discharge are provided and driven using pulse width modulation (PWM). In step 404, multiple LEDs are turned on with a pulse that operates for a first time duration. Typically, the pulse will have a substantially constant current amplitude, but in some embodiments, may slightly increase or decrease. In step 406 the multiple LEDs are turned off for a second selected duration. In step 408, at least some of the multiple LEDs are discharged during a pulse ramp down. In some embodiments, the multiple LEDs can be connected to a discharge circuit until the multiple LEDs are turned on again. This process can be repeated as necessary.

Figure 5:
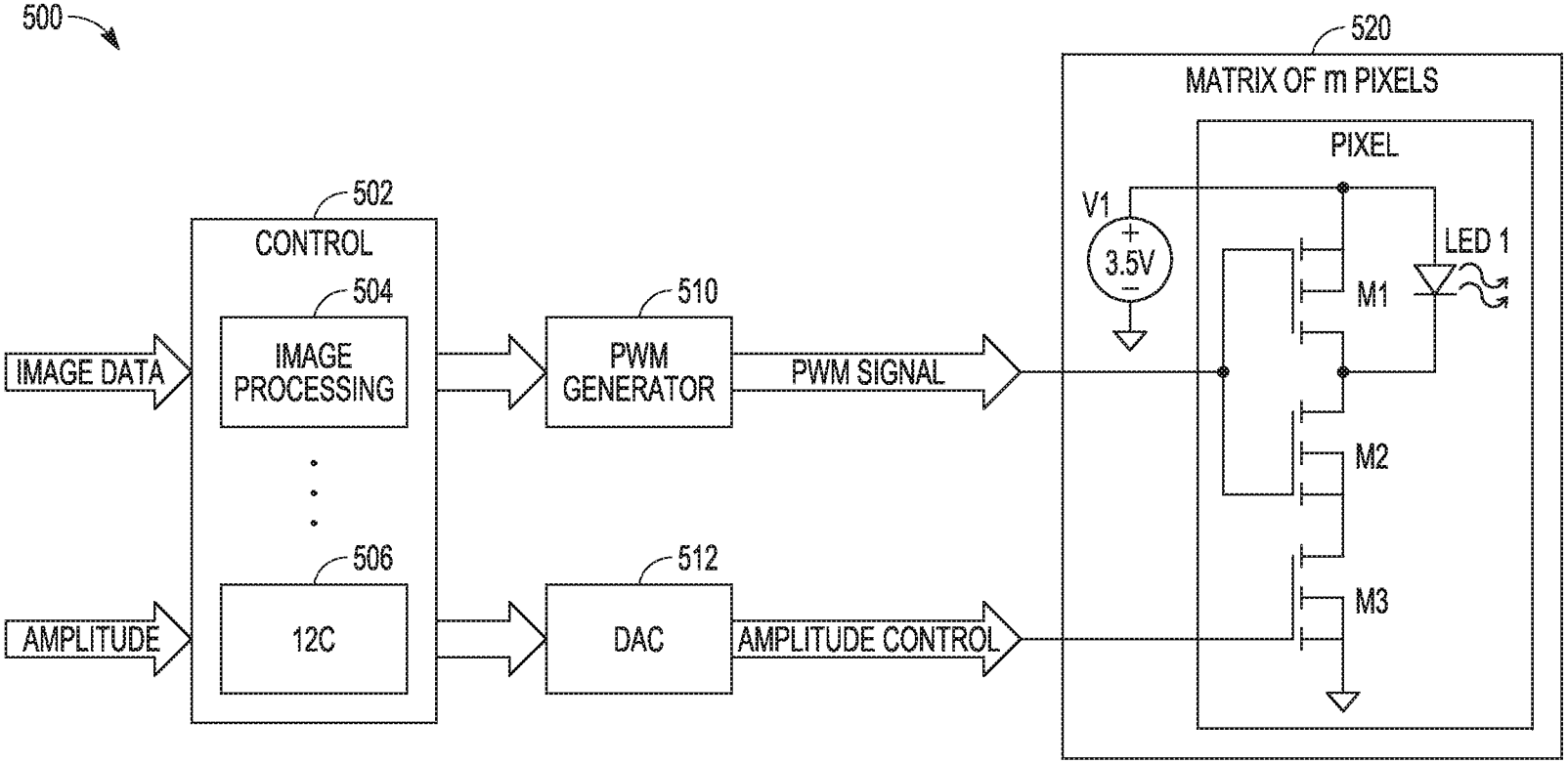
FIG. 5 illustrates some embodiments of matrix micro-LED array systems that include a PWM generator driven by an image processing module that uses active discharge.

In the foregoing described embodiments, intensity can be separately controlled and adjusted by setting appropriate ramp times and pulse width for each LED pixel using a suitable lighting logic and control module and/or PWM module. Parasitic capacitance management can provide LED pixel activation to provide patterned lighting, to reduce power fluctuations, and to provide various pixel diagnostic functionality. A control system 500 that can provide the parasitic capacitance management is illustrated in FIG. 5. As seen in FIG. 5, a matrix micro-LED array can contain arrays of thousands to millions of microscopic LED pixels that actively emit light and are individually controlled. To emit light in a pattern or sequence that results in display of an image, the current levels of the micro-LED pixels at different locations on an array are adjusted individually according to a specific image. This can involve a PWM, which turns on and off the pixels at a certain frequency. During PWM operation, the average DC current through a pixel is the product of the electrical current amplitude and the PWM duty cycle, which is the ratio between the conduction time and the period or cycle time.

Processing modules that facilitate efficient usage of the system 500 are illustrated in FIG. 5. The system 500 includes a control module 502 able to implement pixel or group pixel level control of amplitude and duty cycle for circuitry and procedures such as discussed with respect to FIGS. 1A-C, FIGS. 2-3, and FIG. 4. In some embodiments, the system 500 further includes an image processing module 504 to generate, process, or transmit an image, and digital control interfaces 506, such as inter-integrated circuit (I2C), serial peripheral interface (SPI), controller area network (CAN), universal asynchronous receiver transmitter (UART), or the like, that is configured to transmit control data and/or instructions. The digital control interfaces 506 and control module 502 may include a system microcontroller and any type of wired or wireless module configured to receive a control input from an external device. By way of example, a wireless module may include bluetooth, Zigbee, Z-wave, mesh, WiFi, near field communication (NFC) and/or peer to peer modules may be used. The microcontroller may be any type of special purpose computer or processor that may be embedded in an LED lighting system and configured or configurable to receive inputs from the wired or wireless module or other modules in the LED system and provide control signals to other modules based thereon. Algorithms implemented by the microcontroller or other suitable control module 502 may be implemented in a computer program, software, or firmware incorporated in a non-transitory computer-readable storage medium for execution by the special purpose processor. Examples of non-transitory computer-readable storage mediums include a read only memory (ROM), a random access memory (RAM), a register, cache memory, and semiconductor memory devices. The memory may be included as part of the microcontroller or may be implemented elsewhere, either on or off a printed circuit or electronics board The term module, as used herein, may refer to electrical and/or electronic components disposed on individual circuit boards that may be soldered to one or more electronics boards. The term module may, however, also refer to electrical and/or electronic components that provide similar functionality, but which may be individually soldered to one or more circuit boards in a same region or in different regions.

The control block 502 can further include the image processing unit 504 and the digital control interfaces 506 such as $I^2C$. As will be appreciated, in some embodiments an image processing computation may be done by the control module 502 through directly generating a modulated image. Alternatively, a standard image file can be processed or otherwise converted to provide modulation to match the image. Image data that mainly contains PWM duty cycle values can be processed for all pixels in image processing module 504. Since amplitude is a fixed value or rarely changed value, amplitude related commands can be given separately through a simpler digital interface, e.g. I2C. The control block 502 interprets digital data, which can be used by PWM generator 510 to generate PWM signals for pixels, and by Digital-to-Analog Converter (DAC) block 512 to generate the control signals for obtaining the required current source amplitude.

In some embodiments, the pixel matrix 520 in FIG. 5 can include m pixels including m common anode LEDs. In one example embodiment the pixel unit includes a single LED, LED1, and three MOSFET switches M1 through M3, and is supplied by the power supply VI of 3.5V. M3 is an N-channel MOSFET whose gate is coupled to the amplitude control signal to generate the required current source amplitude. The P-channel MOSFET M1 is in parallel to LED1 and forms a totem pole pair with the N-channel MOSFET M2. The gates of the M1 and M2 transistor pair are tied together and coupled to the PWM signal. Therefore, when PWM is high, M1 will be turned off and M2 will be turned on. A current will flow through LED1, M2, and M3 with a value determined by the amplitude control signal coupled to M3 gate. When PWM is low, M1 will be turned on and M2 will be turned off. Consequently, the current source of M3 will be cut off and the LED will be fast discharged through M1.

Figure 6:
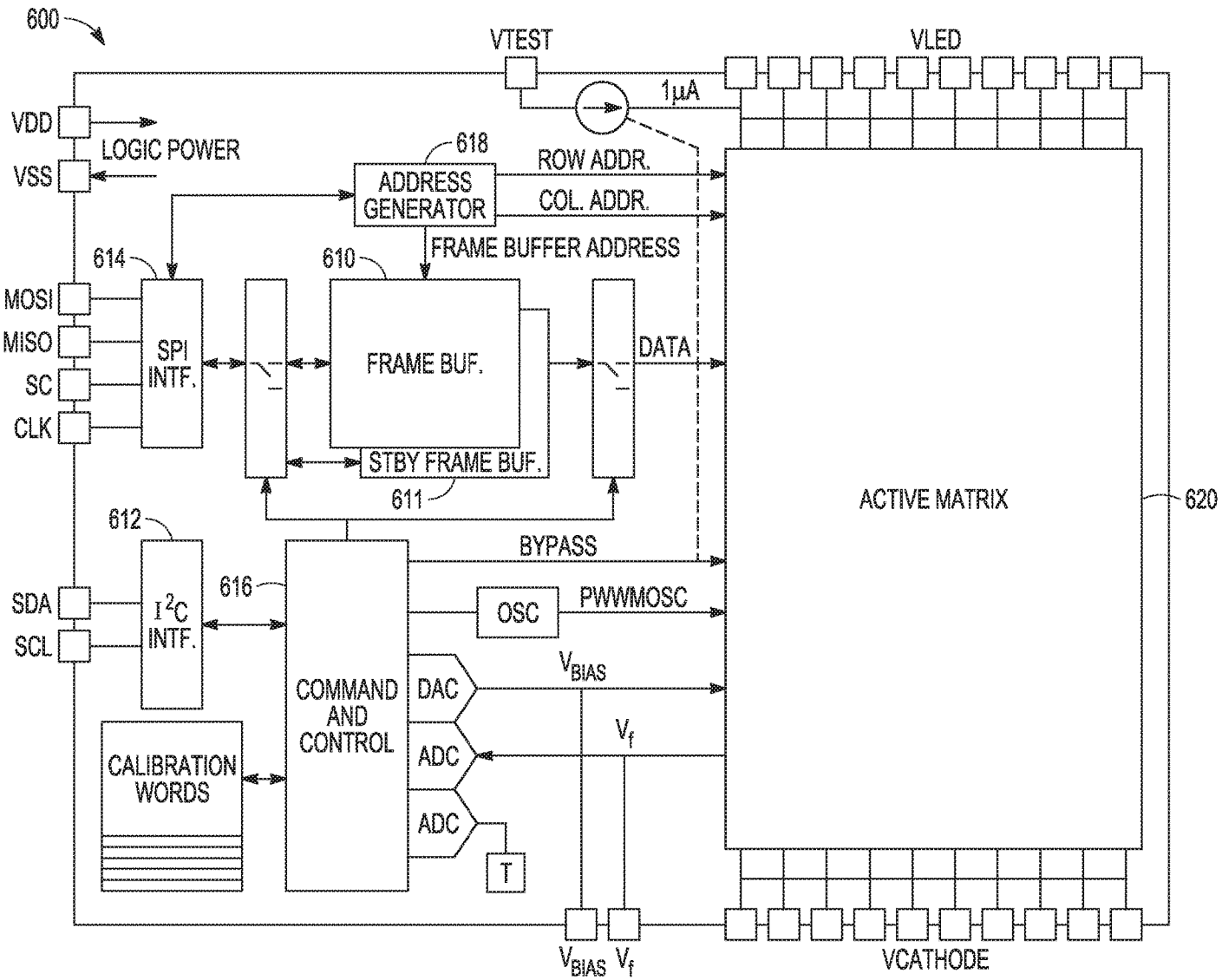
FIG. 6 illustrates a chip level implementation of a system supporting functionality, such as discussed with respect to FIG. 5 or other FIG. discussed herein.

FIG. 6 illustrates a chip level implementation of a system 600 supporting functionality, such as discussed with respect to FIG. 5 or other FIG. discussed herein. The system 600 includes a command and control module 616 able to implement pixel or group pixel level control of amplitude and duty cycle for circuitry and procedures such as discussed with respect to FIGS. 1A-C, FIGS. 2-3, FIG. 4, and FIG. 5. In some embodiments, the system 600 further includes a frame buffer 610 for holding generated or processed images that can be supplied to an active LED matrix 620. Other modules can include digital control interfaces such as Inter-Integrated Circuit (I2C) serial bus (612) or SPI (614) that are configured to transmit control data or instructions.

In operation, system 600 can accept image or other data from a vehicle or other source that arrives via the SPI interface 614. Successive images or video data can be stored in an image frame buffer 610. If no image data is available, one or more standby images held in a standby image buffer 611 can be directed to the image frame buffer 610. Such standby images can include, for example, an intensity and spatial pattern consistent with legally allowed low beam headlamp radiation patterns of a vehicle, or default light radiation patterns for architectural lighting or displays.

In operation, pixels in the images are used to define response of corresponding LED pixels in the array, with intensity and spatial modulation of LED pixels being based on the image(s). To reduce data rate issues, groups of pixels (e.g., 5×5 blocks) can be controlled as single blocks in some embodiments. In some embodiments, high speed and high data rate operation is supported, with pixel values from successive images able to be loaded as successive frames in an image sequence at a rate between about 30 Hz and about 100 Hz, with 60 Hz being typical. PWM can be used to control each pixel to emit light in a pattern and with an intensity at least partially dependent on the image held in the image frame buffer 610.

In some embodiments, the system 600 can receive logic power via $V_{dd}$ and $V_{ss}$ pins. An active matrix receives power for LED array control by multiple $V_{LED}$ and $V_{Cathode}$ pins. The SPI 614 can provide full duplex mode communication using a master-slave architecture with a single master. The master device originates the frame for reading and writing. Multiple slave devices are supported through selection with individual slave select (SS) lines. Input pins can include a Master Output Slave Input (MOSI), a Master Input Slave Output (MISO), a chip select (SC), and clock (CLK), all connected to the SPI interface 614. The SPI interface connects to an address generator, frame buffer, and a standby frame buffer. Pixels can have parameters set and signals or power modified (e.g., by power gating before input to the frame buffer, or after output from the frame buffer via PWM or power gating) by a command and control module. The SPI interface 614 can be connected to an address generation module 618 that in turn provides row and address information to the active matrix 620. The address generator module 618 in turn can provide the frame buffer address to the frame buffer 610.

In some embodiments, the command and control module 616 can be externally controlled via an $I^2C$ serial bus 612. A clock (SCL) pin and data (SDA) pin with 7-bit addressing can be supported. The command and control module 616 can include a digital to analog converter (DAC) and one or more analog to digital converters (ADC). These are respectively used to set $V_{bias}$ for a connected active matrix, help determine maximum $V_f$, and determine system temperature. Also connected are an oscillator (OSC) to set the PWM oscillation (PWMOSC) frequency for the active matrix 620. In one embodiment, a bypass line is also present to allow address of individual pixels or pixel blocks in the active matrix for diagnostic, calibration, or testing purposes. The active matrix 620 can be further supported by row and column select that is used to address individual pixels, which are supplied with a data line, a bypass line, a PWMOSC line, a $V_{bias}$ line, and a $V_f$ line.

In some embodiments, the described circuitry and active matrix LEDs 620 can be packaged and optionally include a submount or printed circuit board connected for powering and controlling light production by the semiconductor LED. In certain embodiments, the printed circuit board can also include electrical vias, heat sinks, ground planes, electrical traces, and flip chip or other mounting systems. The submount or printed circuit board may be formed of any suitable material, such as ceramic, silicon, aluminum, etc. If the submount material is conductive, an insulating layer is formed over the substrate material, and the metal electrode pattern is formed over the insulating layer. The submount can act as a mechanical support, providing an electrical interface between electrodes on the LED and a power supply, and also provide heat sinking.

In some embodiments, the active matrix 620 can be formed from light emitting elements of various types, sizes, and layouts. In one embodiment, one or two dimensional matrix arrays of individually addressable LEDs can be used. Commonly N×M arrays, where N and M are respectively between two and one or more thousand, can be used. Individual LED structures can have a square, rectangular, hexagonal, polygonal, circular, arcuate or other surface shape. Arrays of the LED assemblies or structures can be arranged in geometrically straight rows and columns, staggered rows or columns, curving lines, or semi-random or random layouts. LED assemblies can include multiple LEDs formed as individually addressable pixel arrays are also supported. In some embodiments, radial or other non-rectangular grid arrangements of conductive lines to the LED can be used. In other embodiments, curving, winding, serpentine, and/or other suitable non-linear arrangements of electrically conductive lines to the LEDs can be used.

In some embodiments, arrays of microLEDs (μLEDs or uLEDs) can be used. MicroLEDs can support high density pixels having a lateral dimension less than 100 μm by 100 μm. In some embodiments, microLEDs with dimensions of about 50 μm in diameter or width and smaller can be used. Such microLEDS can be used for the manufacture of color displays by aligning in close proximity microLEDs comprising red, blue and green wavelengths. In other embodiments, microLEDs can be defined on a monolithic gallium nitride (GaN) or other semiconductor substrate, formed on segmented, partially, or fully divided semiconductor substrate, or individually formed or panel assembled as groupings of microLEDs. In some embodiments, the active matrix 620 can include small numbers of microLEDs positioned on substrates that are centimeter scale area or greater. In some embodiments, the active matrix 620 can support microLED pixel arrays with hundreds, thousands, or millions of LEDs positioned together on centimeter scale area substrates or smaller. In some embodiments, microLEDs can include LEDs sized between 30 microns and 500 microns. In some embodiments, each of the light emitting pixels in the light emitting pixel array can be positioned at least 1 millimeter apart to form a sparse LED array. In other embodiments, sparse LED arrays of light emitting pixels can be positioned less than 1 millimeter apart and can be spaced apart by distances ranging from 30 microns to 500 microns. They can be embedded in a solid or a flexible substrate, which can be at least in part transparent. For example, the light emitting pixel arrays can be at least partially embedded in glass, ceramic, or polymeric materials.

Light emitting matrix pixel arrays such as discussed herein may support applications that benefit from fine-grained intensity, spatial, and temporal control of light distribution. This may include, but is not limited to, precise spatial patterning of emitted light from pixel blocks or individual pixels. Depending on the application, emitted light may be spectrally distinct, adaptive over time, and/or environmentally responsive. The light emitting pixel arrays may provide pre-programmed light distribution in various intensity, spatial, or temporal patterns. The emitted light may be based, at least in part, on received sensor data and may be used for optical wireless communications. Associated optics may be distinct at a pixel, pixel block, or device level. An example light emitting pixel array may include a device having a commonly controlled central block of high intensity pixels with an associated common optic, whereas edge pixels may have individual optics. Common applications supported by light emitting pixel arrays include video lighting, automotive headlights, architectural and area illumination, street lighting, and informational displays, among others.

Light emitting matrix pixel arrays may be used to selectively and adaptively illuminate buildings or areas for improved visual display or to reduce lighting costs. In addition, light emitting pixel arrays may be used to project media façades for decorative motion or video effects. In conjunction with tracking sensors and/or cameras, selective illumination of areas around pedestrians may be possible. Spectrally distinct pixels may be used to adjust the color temperature of lighting, as well as support wavelength specific horticultural, farm animal, or other commercial illumination.

Street lighting is an application that may benefit from use of light emitting pixel arrays. A single light emitting array may be used to mimic various street light types, allowing, for example, switching between a Type I linear street light and a Type IV semicircular street light by appropriate activation or deactivation of selected pixels. In addition, street lighting costs may be lowered by adjusting light beam intensity or distribution according to environmental conditions or time of use. For example, light intensity and area of distribution may be reduced when pedestrians are not present. If pixels of the light emitting pixel array are spectrally distinct, the color temperature of the light may be adjusted according to respective daylight, twilight, or night conditions.

Light emitting arrays are also well suited for supporting applications requiring direct or projected displays. For example, warning, emergency, or informational signs may all be displayed or projected using light emitting arrays. This allows, for example, color changing or flashing exit signs to be projected. If a light emitting array is composed of a large number of pixels, textual or numerical information may be presented. Directional arrows or similar indicators may also be provided.

Vehicle headlamps are a light emitting array application that can include large pixel numbers and a high data refresh rate. Automotive headlights that actively illuminate only selected sections of a roadway can be used to reduce problems associated with glare or dazzling of oncoming drivers. Using infrared cameras as sensors, light emitting pixel arrays can activate only those pixels needed to illuminate the roadway, while deactivating pixels that may dazzle pedestrians or drivers of oncoming vehicles. In addition, off-road pedestrians, animals, or signs may be selectively illuminated to improve driver environmental awareness. If pixels of the light emitting pixel array are spectrally distinct, the color temperature of the light may be adjusted according to respective daylight, twilight, or night conditions. Some pixels may be used for optical wireless vehicle to vehicle communication.

An LED light module can include matrix LEDS, alone or in conjunction with primary or secondary optics, including lenses or reflectors. To reduce overall data management requirements, the light module can be limited to on/off functionality or switching between relatively few light intensity levels. Full pixel level control of light intensity is not necessarily supported.

In operation, pixels in the images are used to define response of corresponding LED pixels in the pixel module, with intensity and spatial modulation of LED pixels being based on the image(s). To reduce data rate issues, groups of pixels (e.g., 5×5 blocks) can be controlled as single blocks in some embodiments. High speed and high data rate operation is supported, with pixel values from successive images able to be loaded as successive frames in an image sequence at a rate between about 30 Hz and about 100 Hz, with about 60 Hz being typical. In conjunction with a PWM module, each pixel in the pixel module can be operated to emit light in a pattern and with intensity at least partially dependent on the image held in the image frame buffer.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims. It is also understood that other embodiments of this invention may be practiced in the absence of an element/step not specifically disclosed herein. In those embodiments supporting software controlled hardware, the methods, procedures, and implementations described herein may be realized in a computer program, software, or firmware incorporated in a computer-readable medium for execution by a computer or processor. Examples of computer-readable media include electronic signals (transmitted over wired or wireless connections) and computer-readable storage media. Examples of computer-readable storage media include, but are not limited to, a read only memory (ROM), a random access memory (RAM), a register, cache memory, semiconductor memory devices, magnetic media such as internal hard disks and removable disks, magneto-optical media, and optical media such as CD-ROM disks, and digital versatile disks (DVDs).

The invention claimed is:

1. A control system for a light emitting diode (LED) array, comprising:

a pulse width modulator to supply signals having rising edges and falling edges to a plurality of LEDs of the LED array;

a voltage source;

a current source; and a plurality of parasitic capacitance discharge circuit elements including a plurality of switches and a plurality of current sources, one switch of the switches and one current source of the current sources for each LED, each switch of the switches connected in parallel with a respective LED of the plurality of LEDs and each current source of the current sources electrically connected in series with the respective LED, the plurality of parasitic capacitance discharge circuit elements actively discharge a parasitic capacitance of the respective LED and reduce a discharge time of the parasitic capacitance from the respective LED.

2. The control system of claim 1, wherein plurality of LEDs comprise a matrix pixel array.

3. The control system of claim 1, wherein the rising edges and falling edges have a same slope.

4. The control system of claim 1, wherein the plurality of LEDs are common anode LEDs.

5. The control system of claim 1, wherein the plurality of LEDs are common cathode LEDs.

6. The control system of claim 1, wherein the current sources are configured to operate at 180 degrees phase relationship with respect to the pulse width modulator.

7. The control system of claim 1, wherein at least one of the plurality of LEDs is controlled by three metal oxide semiconductor field effect transistor (MOSFET) switches M1, M2, and M3, with parasitic capacitance discharge occurring through M1.

8. The control system of claim 1, wherein at least one of the plurality of LEDs is controlled by three metal oxide semiconductor field effect transistor (MOSFET) switches M1, M2, and M3, with M1 being a P-channel MOSFET connected in parallel to LED1 and forming a totem pole pair with a N-Channel MOSFET M2, and parasitic capacitance discharge occurring through M1.

9. A control system for a light emitting diode (LED) array, comprising:

a control module providing image data corresponding to an image to be displayed by the LED array, the image data including pulse width modulation (PWM) data for each of a plurality of LEDs of the LED array;

a pulse width modulator connected to the control module to receive PWM data from the control module and to supply PWM signals having a rising edge and a falling edges to the plurality of LEDs; and a plurality of parasitic capacitance discharge circuit elements including a plurality of switches and a plurality of current sources, one switch of the switches and one current source of the current sources for each LED, each switch of the switches connected in parallel with a respective LED of the plurality of LEDs and each current source of the current sources electrically connected in series with the respective LED, the plurality of parasitic capacitance discharge circuit elements actively discharge a parasitic capacitance of the respective LED and reduce a discharge time of the parasitic capacitance from the respective LED.

10. The control system of claim 9, wherein at least one of the plurality of LEDs is controlled by three metal oxide semiconductor field effect transistor (MOSFET) switches M1, M2, and M3, with parasitic capacitance discharge occurring through M1.

11. The control system of claim 9, wherein at least one of the plurality of LEDs is controlled by three metal oxide semiconductor field effect transistor (MOSFET) switches M1, M2, and M3, with M1 being a P-channel MOSFET connected in parallel to LED1 and forming a totem pole pair with a N-Channel MOSFET M2, and parasitic capacitance discharge occurring through M1.

12. The control system of claim 9, wherein plurality of LEDs comprise a matrix pixel array.

13. A control method for a light emitting diode (LED) array, comprising:

providing the LED array including a plurality of LEDS;

powering the plurality of LEDs with a pulse width modulator to supply signals having rising edges and falling edges; and discharging a parasitic capacitance of each of the plurality of LEDS using separately connected parasitic capacitance discharge circuit elements, each of the parasitic capacitance discharge circuit elements including a plurality of switches and a plurality of current sources, one switch of the switches and one current source of the current sources for each LED, each switch of the switches connected in parallel with a respective LED of the plurality of LEDs and each current source of the current sources electrically connected in series with the respective LED, the plurality of parasitic capacitance discharge circuit elements actively discharge a parasitic capacitance of the respective LED and reduce a discharge time of the parasitic capacitance from the respective LED.

14. The control method of claim 13, further comprising:

closing the switches during a falling edge of the falling edges; and opening the switches before an immediately subsequent rising edge of the rising edges.

* * * * *